US012471624B2

(12) United States Patent
Chen

(10) Patent No.: US 12,471,624 B2
(45) Date of Patent: Nov. 18, 2025

(54) HOOKAH MAIN UNIT WITH ENHANCED ATOMIZING AIRWAY AND ELECTRONIC HOOKAH

(71) Applicant: Shenzhen Impetus Technology Co., Ltd., Guangdong (CN)

(72) Inventor: Liqian Chen, Guangdong (CN)

(73) Assignee: Shenzhen Impetus Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/176,187

(22) Filed: Apr. 11, 2025

(65) Prior Publication Data

US 2025/0331557 A1 Oct. 30, 2025

(30) Foreign Application Priority Data

Apr. 26, 2024 (CN) ..... 202410515413.7

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS

2020/0337369 A1* 10/2020 Emmett ..... A24F 1/32

* cited by examiner

*Primary Examiner* — Dennis R Cordray

(57) ABSTRACT

The present disclosure relates to a hookah main unit with an enhanced atomizing airway and an electronic hookah. The hookah main unit specifically includes a main unit, which is provided with a second air inlet, an air outlet, a cavity configured to load tobacco materials, and a heating component configured to heat the tobacco materials, where the second air inlet is communicated with the cavity and the air outlet to form a second airway; there is at least one second air inlet arranged around the cavity; when air is pumped through the air outlet, external unheated air enters through the second air inlet to be mixed with a heated gas around the cavity, and is discharged from the air outlet.

16 Claims, 14 Drawing Sheets

HOOKAH MAIN UNIT WITH ENHANCED ATOMIZING AIRWAY AND ELECTRONIC HOOKAH

CROSS-REFERENCE TO RELATED APPLICATION

The present application claims priority from Chinese Patent Application No. 202410515413.7 filed on Apr. 26, 2024, the contents of which are incorporated herein by reference in their entirety.

TECHNICAL FIELD

The present disclosure relates to the technical field of hookahs, and in particular, to a hookah main unit with an enhanced atomizing airway and an electronic hookah.

BACKGROUND

Arabian hookahs are originated in India and mainly popular in Arab countries. Similar hookahs can also be found in Turkey, Iran, and Central Asia. Traditional smoking utensils for smoking Arab hookahs usually have a tobacco bowl for containing tobacco materials at the top and have water at the bottom. When in use, burning charcoal fire is placed on the tobacco materials to heat and atomize the tobacco materials to form smoke, which is filtered by water. Finally, hookahs are smoked through a pipe.

However, for the tobacco materials placed in the tobacco bowl, only a part at the surface of the tobacco materials away from the tobacco bowl is in contact with the external air, so that it is difficult for the air in the tobacco bowl to enter the tobacco materials evenly, and the tobacco materials are not incompletely combusted to result in a poor atomizing effect of the tobacco materials.

SUMMARY

In view of the above problems, embodiments of the present disclosure are put forward in order to provide a hookah main unit with an enhanced atomizing airway and an electronic hookah to overcome or at least partially solve the above problems.

A hookah main unit with an enhanced atomizing airway, including a main unit, where:

the main unit is provided with a second air inlet, an air outlet, a cavity configured to load tobacco materials, and a heating component configured to heat the tobacco materials, where there is at least one second air inlet;

the second air inlet is communicated with the cavity and the air outlet to form a second airway; and when air is pumped through the air outlet, external unheated air enters through the second air inlet to be mixed with a heated gas around the tobacco materials in the cavity, and is discharged from the air outlet.

Preferably, the second air inlet is communicated with the cavity only.

Preferably, a heating surface of the heating component is arranged opposite to the cavity.

Preferably, an opening of the second air inlet has a height not greater than the highest level of the tobacco materials.

Preferably, the main unit includes a first component and a second component connected with the first component;

the first component is provided with the heating component; and the second component is provided with the second air inlet, the air outlet, and the cavity;

or, the first component is provided with the heating component and the cavity, and the second component is provided with the second air inlet and the air outlet.

Preferably, the main unit includes a first component and a second component connected with the first component;

the first component is provided with the heating component, the cavity, and the second air inlet, and the second component is provided with the air outlet;

or, the first component is provided with the heating component and the second air inlet, and the second component is provided with the air outlet and the cavity.

Preferably, the second air inlet is arranged at the bottom of the second component.

Preferably, the air outlet is arranged at the center of the bottom of the second component, and the second air inlet is arranged around the air outlet.

Preferably, the second air inlets are arranged at equal intervals.

Preferably, the main unit includes a first air inlet, and the first air inlet is communicated with the air outlet to form a first airway;

when air is pumped through the air outlet, the external unheated air enters through the first air inlet, and is heated by the heating component, mixed with gas at a second temperature in the cavity and discharged from the air outlet, where a temperature of the external unheated air after being heated is lower than the second temperature.

To achieve the above purposes, the present disclosure also includes an electronic hookah. The electronic hookah includes the hookah main unit with an enhanced atomizing airway and a container, where:

a second component is communicated with the container filled with filtrate.

The present disclosure specifically includes the following advantages.

In the embodiments of the present disclosure, compared with the fact in the prior art that "for the tobacco materials placed in the tobacco bowl, only a part at the surface of the tobacco materials away from the tobacco bowl is in contact with the external air, so that it is difficult for the air in the tobacco bowl to enter the tobacco materials evenly, and the tobacco materials are not incompletely combusted to result in a poor atomizing effect of the tobacco materials", the present disclosure provides a solution of "a second air inlet". The present disclosure specifically includes a main unit, which is provided with a second air inlet, a second airway, an air outlet, a cavity configured to load tobacco materials, and a heating component configured to heat the tobacco materials. The second air inlet is communicated with the cavity and the air outlet to form the second airway. There is at least one second air inlet arranged around the cavity. When air is pumped through the air outlet, the external unheated air enters through the second air inlet to be mixed with the heated gas around the cavity, and is discharged from the air outlet. By means of the "second air inlet", the problem that for the tobacco materials placed in the tobacco bowl, only a part at the surface of the tobacco materials away from the tobacco bowl is in contact with the external air, so that it is difficult for the air in the tobacco bowl to enter the tobacco materials evenly, and the tobacco materials are not incompletely combusted to result in a poor atomizing effect of the tobacco materials is solved, and it is ensured that the cold air and the heated gas of the tobacco materials are convectively atomized and are discharged from the air outlet during use, thereby improving energy utilization efficiency.

BRIEF DESCRIPTION OF DRAWINGS

In order to explain the technical scheme of the present disclosure more clearly, the drawings needed in the description of the present disclosure will be briefly introduced hereinafter. Obviously, the drawings in the following description are some embodiments of the present disclosure only. For those of ordinary skill in the art, other drawings can also be obtained according to these drawings without creative efforts.

Figure 1:
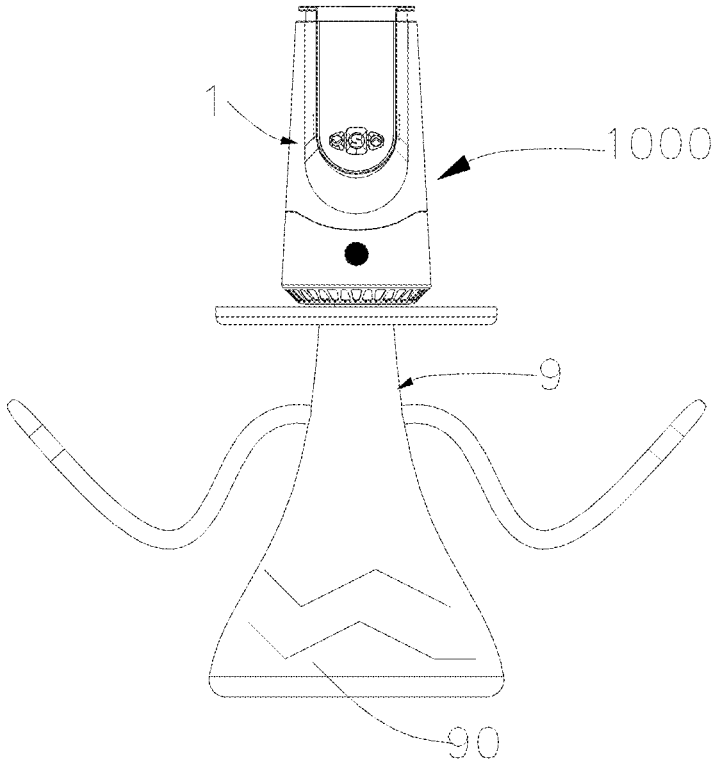
FIG. 1 is a schematic structural diagram of an electronic hookah according to an embodiment of the present disclosure.

1000, electronic hookah; 1, main unit; 10, first component; 11, first bracket; 12, first housing; 15, heating component; 151, heating assembly; 1511, sheet-like heating element; 1512, connecting line; 1513, second air vent; 1514, electric heating materials; 153, protective cover; 1531, third air vent; 154, heat insulation assembly; 1541, heat insulator; 1542, heat insulation bracket; 1543, heat insulation sheet assembly; 15430, first heat insulation sheet; 154301, fourth air vent; 15431, second heat insulation sheet; 1544, first gap; 1545, second gap; 16, first airway; 17, first air inlet; 20, second component; 21, heating chamber; 22, atomizing pot; 221, pot body; 2210, first air vent; 2212, top; 2213, side; 2214, cavity; 22141, opening; 2215, tobacco material; 222, pot cover; 23, adapter portion; 230, air outlet; 231, adapter portion body; 232, socket; 234, second air inlet; 235, edge; 24, second airway; 25, second bracket; 26, second housing; 27, gap; 9, container; 90, filtrate; 91, pipe; 910, mouthpiece; 92, kettle body; 93, support table; 94, adapter.

DETAILED DESCRIPTION

In order to make the objects, features and advantages of the present disclosure more obvious and understandable, the present disclosure will be further described in detail with reference to the drawings and the detailed implementations. Obviously, the described embodiments are some, rather than all, of the embodiments of the present disclosure. Based on the embodiments in the present disclosure, all other embodiments obtained by those of ordinary skill in the art without creative efforts shall fall within the scope of protection of the present disclosure.

By analyzing the prior art, the inventor found that in the use process of traditional Arabian hookahs, the combustion efficiency of tobacco materials is low because the tobacco materials are in contact with the surface of the tobacco bowl only, which affects the quality and taste of the smoke. In addition, incomplete combustion of tobacco materials may also produce some harmful substances, posing a potential threat to health.

In order to solve this problem, the present disclosure uses a more advanced heating method to replace the traditional charcoal fire with an electric heater, so that tobacco materials can be heated more evenly, and the combustion efficiency can be improved. At the same time, in the improved design, tobacco materials are placed in a more open container, so that the air can flow more evenly, thereby improving the combustion efficiency. Generally speaking, although the traditional Arab hookahs have some shortcomings, these problems can be effectively solved through some improved designs and technologies.

In the embodiments of the present disclosure, compared with the fact in the prior art that "for the tobacco materials 2215 placed in the tobacco bowl, only a part at the surface of the tobacco materials 2215 away from the tobacco bowl is in contact with the external air, so that it is difficult for the air in the tobacco bowl to enter the tobacco materials 2215 evenly, and the tobacco materials 2215 are not incompletely combusted to reduce the heating and atomizing efficiency of the tobacco materials 2215", the present disclosure provides a solution of "a second air inlet". The present disclosure specifically includes a main unit 1. The main unit 1 is provided with a second air inlet 234, a second airway, an air outlet 230, a cavity configured to load tobacco materials 2215, and a heating component 15 configured to heat the tobacco materials 2215. The second air inlet 234 is communicated with the cavity and the air outlet 230 to form the second airway. There is at least one second air inlet 234 arranged around the cavity. When air is pumped through the air outlet 230, external unheated air enters through the second air inlet 234 to be mixed with a heated gas around the cavity, and is discharged from the air outlet 230. By means of the "second air inlet 234", the problem that for the tobacco materials 2215 placed in the tobacco bowl, only a part at the surface of the tobacco materials 2215 away from the tobacco bowl is in contact with the external air, so that it is difficult for the air in the tobacco bowl to enter the tobacco materials 2215 evenly, and the tobacco materials 2215 are not incompletely combusted to reduce the heating and atomizing efficiency of the tobacco materials 2215 is solved, and it is ensured that the cold air and the heated gas of the tobacco materials 2215 are convectively atomized and are discharged from the air outlet 230 during use, thereby improving energy utilization efficiency.

Referring to FIG. 1, a schematic structural diagram of an airway structure of an electronic hookah 1000 according to the present disclosure is shown, which may specifically include the following structure. The present disclosure includes a main unit 1. The main unit 1 is provided with a second air inlet 234, a second airway, an air outlet 230, a cavity configured to load tobacco materials 2215, and a heating component 15 configured to heat the tobacco materials 2215. The second air inlet 234 is communicated with the cavity and the air outlet 230 to form a second airway. There is at least one second air inlet 234 arranged around the cavity. When air is pumped through the air outlet 230, the external unheated air enters through the second air inlet 234 to be mixed with the heated gas around the cavity, and is discharged from the air outlet 230.

An airway structure of an electronic hookah 1000 in this exemplary embodiment will be further described hereinafter.

In an embodiment of the present disclosure, the main unit 1 includes a first component 10 and a second component 20 connected with the first component 10. The first component 10 is detachably connected with the second component 20; or, the first component 10 and the second component 20 may be arranged integrally.

In a specific embodiment, the first component 10 and the second component 20 are snap-connected by a side connecting component at a side, so that the second component 20 can be disassembled and washed conveniently. The connecting component is designed to be detachable and washable to facilitate cleaning and maintenance. The first component 10 and the second component 20 are snap-connected by a connecting component at a side, which connecting method is not only convenient for disassembly and installation, but also can ensure the stability and the reliability of the components. The first component 10 and the second component 20 can be snap-connected through the following steps. A snap hole is provided on the side of the first component 10, with the shape and size of the snap hole matching the connecting component. A snap protrusion is provided on the side of the second component 20, with the shape and size of the snap protrusion matching the snap hole. The sides of the first component 10 and the second component 20 are placed opposite to each other, so that the snap protrusion is inserted into the snap hole. A certain pressure is applied, so that the snap protrusion is snap-connected with the snap hole, thereby fixing the first component 10 and the second component 20 together. When the first component 10 and the second component 20 need to be disassembled and washed, it is only necessary to pull out the snap protrusion from the snap hole, so that the components can be disassembled. The connecting method is simple to operate and easy to implement.

In an embodiment of the present disclosure, the main unit 1 includes a first component 10 and a second component 20 connected with the first component 10. The first component 10 is provided with the heating component 15 and the cavity, and the second component 20 is provided with the second air inlet 234 and the air outlet 230. The first component 10 is provided with the heating component 15 and the cavity configured to load the tobacco materials, and the second component 20 is provided with the second air inlet 234 and the air outlet 230. With this design, the heating component 15 and the cavity configured to load the tobacco materials can be located in the first component 10, while the second air inlet 234 and the air outlet 230 can be located in the second component 20.

In an embodiment of the present disclosure, the main unit 1 includes a first component 10 and a second component 20 connected with the first component 10. The first component 10 is provided with the heating component 15, the cavity, and the second air inlet 234, and the second component 20 is provided with the air outlet 230. The main unit 1 includes a first component 10 and a second component 20, which are combined through connection. The first component 10 is provided with the heating component 15, the cavity, and the second air inlet 234, while the second component 20 is provided with the air outlet 230, which structural design enables air to enter the cavity inside the main unit 1 through the second air inlet 234, and the air is heated by the heating component 15 and finally discharged from the air outlet 230, thereby achieving the functions of heating and filtering the air.

In an embodiment of the present disclosure, the main unit 1 includes a first component 10 and a second component 20 connected with the first component 10. The first component 10 is provided with the heating component 15 and the second air inlet 234, and the second component 20 is provided with the air outlet 230 and the cavity configured to load the tobacco materials. The first component 10 is provided with the heating component 15 and the second air inlet 234, and the second component 20 is provided with the air outlet 230 and the cavity configured to load the tobacco materials, which design enables the heating component 15 to effectively heat the tobacco materials, and at the same time, the smoke can flow through the second air inlet 234 and the air outlet 230, thereby improving the smoking experience. The second air inlet 234 is connected with the cavity through an airway, of which one section is in the first component 10, and the other section is in the second component 20. Both sections are communicated with each other.

Figure 15:
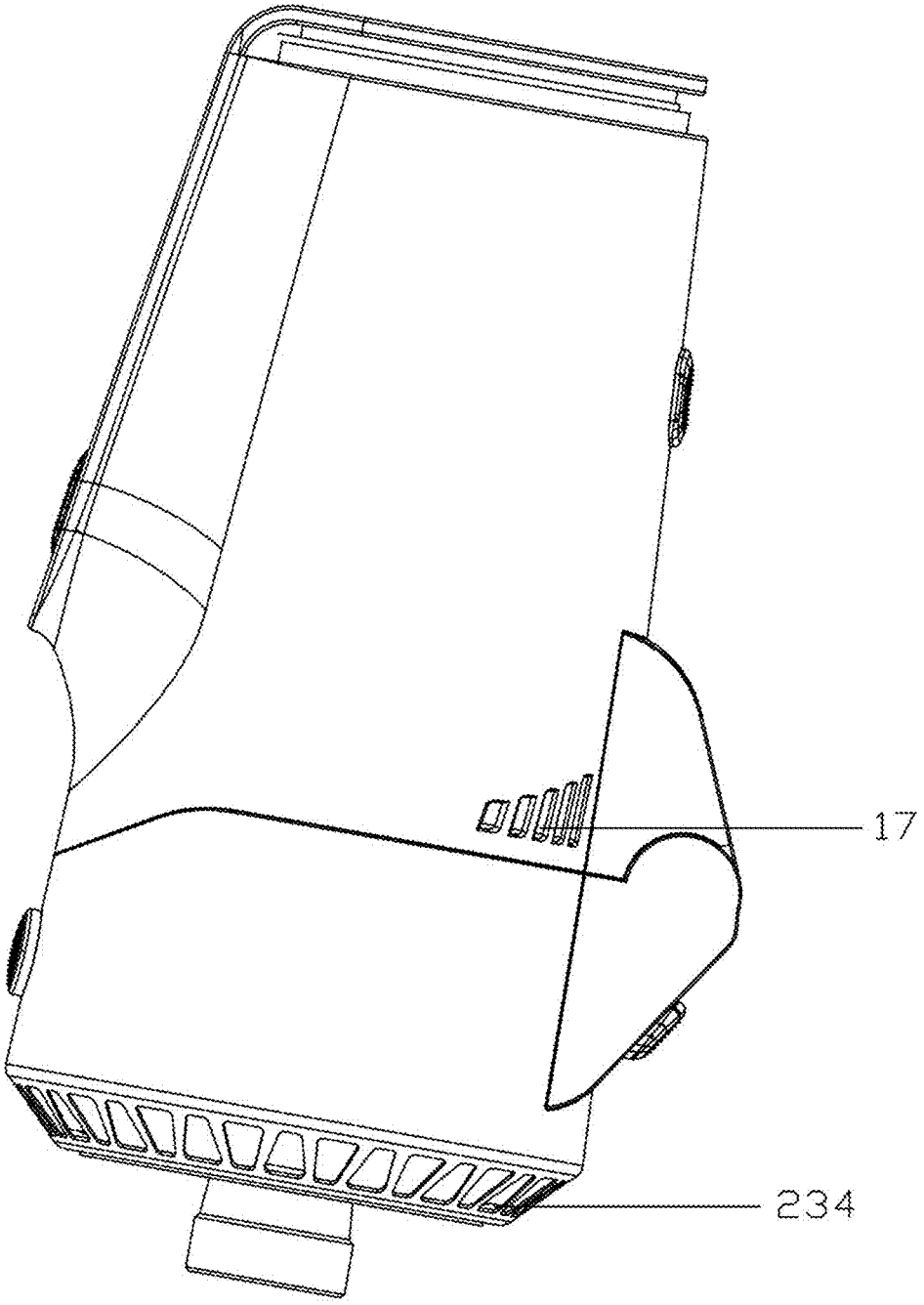
FIG. 15 is a schematic structural diagram of a first air inlet according to an embodiment of the present disclosure.

In an embodiment of the present disclosure, as shown in FIG. 15, the main unit 1 is provided with a first air inlet 17 and a first airway. The first air inlet 17 is communicated with the air outlet 230 to form the first airway. The first air inlet 17 is arranged around the heating component 15. When air is pumped through the air outlet 230, the external unheated air enters through the first air inlet 17, passes through the heating component 15 to form heated gas to be mixed with the air in the first air inlet 17, and is discharged from the air outlet 230. The main unit 1 includes a first air inlet 17. The first air inlet 17 is communicated with the air outlet 230 to form a first airway. When air is pumped through the air outlet 230, the external unheated air enters through the first air inlet 17, and is heated by the heating component 15, mixed with the gas at the second temperature in the cavity, and discharged from the air outlet 230. A temperature of the external unheated air after being heated is lower than the second temperature.

It should be noted that the principle of the present disclosure is that the heated tobacco materials and the heated gas and unheated gas around the tobacco materials are convectively pumped into the filtrate in the container to form smoke.

As an example, the first component 10 is provided with a heating component 15 configured to heat the tobacco materials 2215. The main unit 1 is provided with a first air inlet 17 and a first airway. The first air inlet 17 is communicated with the air outlet 230 to form the first airway. The first air inlet 17 is arranged around the heating component 15. When air is pumped through the air outlet 230, the external air enters through the first air inlet 17, passes through the heating component 15 to form heated gas to be mixed with the air in the second air inlet 234, and is discharged from the air outlet 230.

In a specific embodiment, the present disclosure includes a detachable first component 10, and the first component 10 contains a heating component 15 configured to heat the tobacco materials 2215. The first air inlet 17 is communicated with the air outlet 230 to form a first airway. When air is pumped through the air outlet 230, the external unheated air enters through the first air inlet 17 and is heated by the heating component 15 to form heated gas. This heated gas is then mixed with the cold air entering through the first air inlet 17. The cold air and the hot air form convective atomization and then are discharged from the air outlet 230. This design allows the user to inhale the steam or aerosol generated by the heated tobacco materials 2215. The design of the present disclosure is also helpful to control the heating process, which may improve the efficiency and safety of the device.

It should be noted that the cold air may enter from the first air inlet 17 or from the second air inlet 234, either of which may be acceptable.

As an example, a plurality of the first air inlets 17 are longitudinally symmetrically arranged on both sides of the heating component 15, and the first air inlets 17 on each side are arranged side by side. The first air inlets 17 may be arranged in a strip shape.

As an example, the first air inlet 17 is arranged around the first gap.

In an embodiment of the present disclosure, the main unit 1 is provided with a heating component 15. The main unit 1 is provided with a first air inlet 17, a first airway, an air outlet 230, a cavity configured to load the tobacco materials 2215, and a heating component 15 configured to heat the tobacco materials 2215. There is at least one first air inlet 17. The first air inlet 17 is communicated with the heating component 15 and the air outlet 230 to form the first airway. When air is pumped through the air outlet 230, the external unheated air enters through the first air inlet 17, is heated by the heating component 15 to obtain heated gas to be mixed with air at a second temperature, and is discharged from the air outlet 230. The temperature of the air at the second temperature is lower than that of the heated gas. By means of the design of the present disclosure, the tobacco materials 2215 can be heated evenly, and the mixing ratio of the heated gas and the air at the second temperature can be adjusted by controlling the first air inlet 17 and the air outlet 230, so as to control the temperature and humidity of the discharged gas, thereby improving the user experience.

In an embodiment of the present disclosure, the first air inlet 17 is communicated with the heating component 15, and the heating component 15 is communicated with the cavity. The first air inlet 17 is communicated with the heating component 15, the heating component 15 is communicated with the cavity, and the first air inlet 17 is connected with the cavity through the heating component 15. The structural design of the present disclosure may enable the heating component 15 to receive the air from the first air inlet 17, heat the air through the heating component 15, and then convey the heated air into the cavity.

In an embodiment of the present disclosure, a heating surface of the heating component 15 is arranged opposite to the cavity. The cavity is located where the atomizing pot is placed. The tobacco materials 2215 are placed inside the atomizing pot. The atomizing pot includes a pot body and a pot cover matching the pot body. The pot body and the pot cover are each provided with the first air vent 2210.

In an embodiment of the present disclosure, the heating component 15 includes a sheet-like heating element 1511 and a protective cover 153. The protective cover 153 is arranged on a side of the sheet-like heating element 1511 facing the tobacco materials 2215. The heating component 15 also includes a heat insulation bracket 1542 and a heat insulator 1541. The heat insulation bracket 1542 and the heat insulator 1541 are arranged at intervals to form a first gap, and the sheet-like heating element 1511 and the protective cover 153 are disposed inside the heat insulation bracket 1542.

In a specific embodiment, the heating component 15 includes a sheet-like heating element 1511 and a protective cover 153. The protective cover 153 is arranged on a side of the sheet-like heating element 1511 facing the tobacco materials 2215. In addition, the heating component 15 also includes a heat insulation bracket 1542 and a heat insulator 1541, which are arranged at intervals to form a first gap, and the sheet-like heating element 1511 and the protective cover 153 are disposed inside the heat insulation bracket 1542. This design can be used to effectively isolate the heating element from the external environment, prevent heat loss, improve the heating efficiency, and at the same time protect the heating element from external factors and prolong its service life. The sheet-like heating element 1511 is made of a super-thermal conductive material that is SUS430.

In an embodiment of the present disclosure, the heating component 15 includes a second air vent assembly. The second air vent assembly passes through the heating component 15.

In a specific embodiment, the second air vent assembly includes a second air vent 1513 and a third air vent 1531. The second air vent 1513 is arranged on the sheet-like heating element 1511. The third air vent 1531 is arranged on the protective cover 153. The shape and the pattern of the second air vent 1513 are as the same as those of the third air vent 1531.

In a specific embodiment, a first heat insulation sheet 15430 and a second heat insulation sheet for heat insulation are provided between the heat insulator 1541 and the heat insulation bracket 1542. The sheet-like heating element 1511 includes a temperature sensing device. One end of the temperature sensing device is fixedly connected with the sheet-like heating element 1511. Both the first heat insulation sheet 15430 and the second heat insulation sheet may be made of mica sheets.

In a specific embodiment, the top of the heating component 15 is provided with a battery for supplying power to the whole device. The heat insulation assembly 154 is configured to separate the battery from the heating assembly. The heat insulation assembly 154 is used to prevent heat loss and protect the battery from high temperature. An appropriate type of batteries is selected according to the heating power, such as lithium-ion batteries and nickel-metal hydride batteries.

In a specific embodiment, the main unit 1 is also provided with an electronic screen. The electronic screen is electrically connected with both the circuit board and the battery. The electronic screen is an LED screen.

Figure 16:
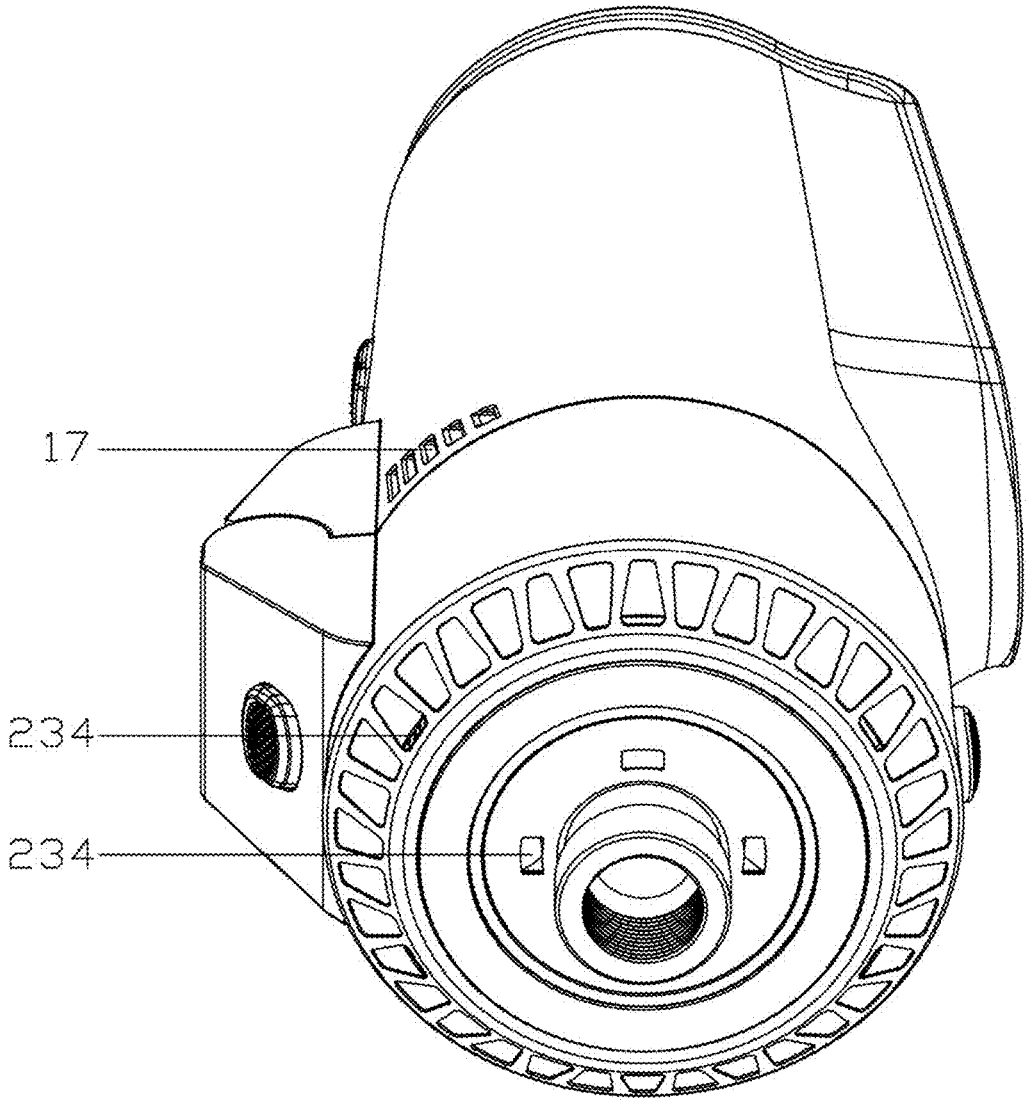
FIG. 16 is a schematic structural diagram of a first air inlet and a second air inlet according to an embodiment of the present disclosure.
Figure 17:
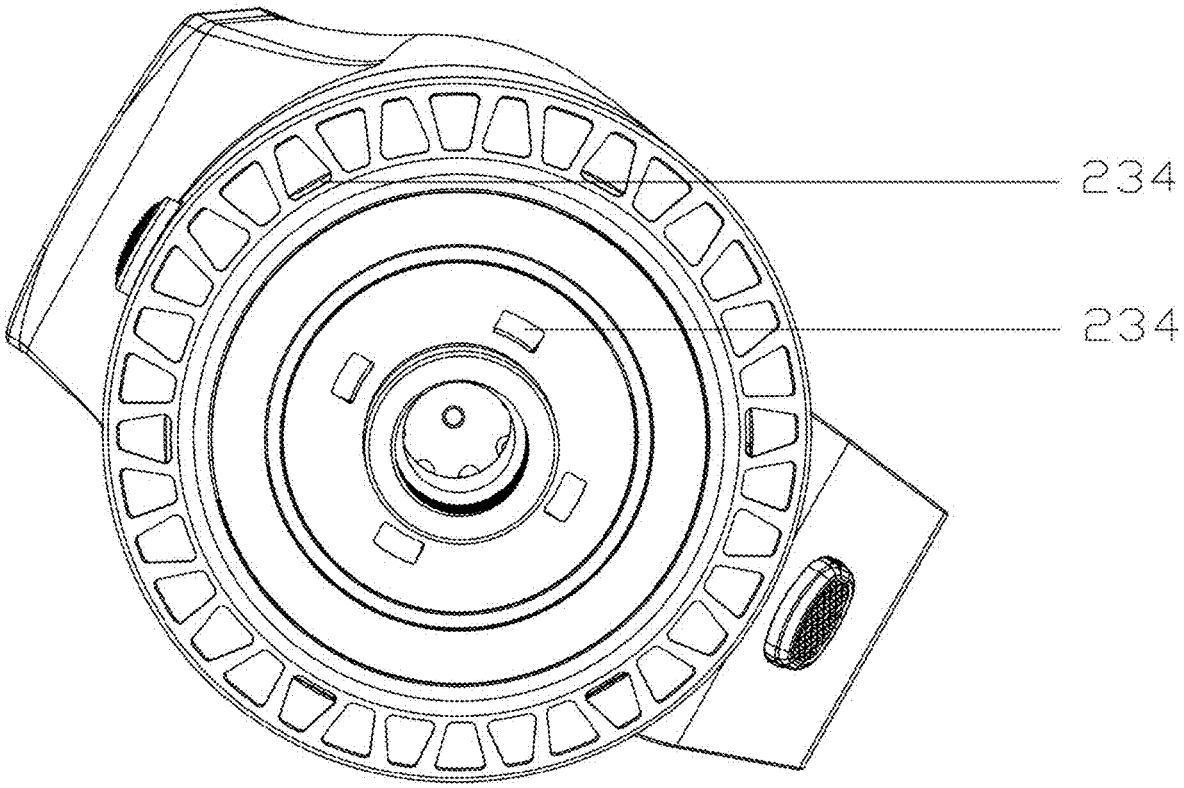
FIG. 17 is a schematic structural diagram of a second air inlet according to an embodiment of the present disclosure.

In an embodiment of the present disclosure, as shown in FIG. 16 and FIG. 17, the second component 20 is provided with the second air inlet 234, the second airway, the air outlet 230, and the cavity. The second air inlet 234 is communicated with the cavity and the air outlet 230 to form a second airway. When air is pumped through the air outlet 230, the external unheated air enters through the second air inlet 234, and is mixed with the heated gas around the tobacco materials 2215 in the cavity and discharged from the air outlet 230.

In an embodiment of the present disclosure, the second air inlet 234 is communicated with the cavity only. The second air inlet 234 does not pass through the heating component 15 and can be obtained by defining an opening in any direction outside the main unit 1, and the second air inlet 234 is communicated with the cavity by bypassing the heating assembly; or, an opening is defined in the inclined direction outside the main unit 1 to be communicated with the cavity.

As an example, the heating surface of the heating component 15 is arranged opposite to the cavity. The heating surface of the heating component 15 is opposite to the cavity configured to load the tobacco materials 2215, so as to deliver heat to the tobacco materials 2215 in the cavity through the heating surface. This configuration contributes to the combustion process, thereby improving the quality and taste of the product of the tobacco materials 2215.

In an embodiment of the present disclosure, the opening of the second air inlet 234 has a height not greater than the highest level of the tobacco materials 2215. When the opening of the second air inlet 234 has a height equal to or less than the highest level of the tobacco materials 2215, the tobacco materials 2215 are in full contact with the air, and the taste of the tobacco materials 2215 is better.

In an embodiment of the present disclosure, the second air inlet 234 is arranged at the bottom of the second component 20. The air outlet 230 is arranged at the center of the bottom of the second component 20. The second air inlet 234 is arranged around the air outlet 230.

In a specific embodiment, the second air inlet 234 is arranged at the bottom of the second component 20, and the air outlet 230 is located at the center of the bottom of the second component 20. The second air inlet 234 is arranged around the air outlet 230. By means of the design of the present disclosure, that the gas can flow into the second component 20 through the second air inlet 234 evenly and be discharged through the air outlet 230 at the center can be ensured. This structure is very useful in applications that require precise control of air flow distribution, such as heat exchangers, burners or other devices that require precise gas distribution. The second air inlet 234 is provided to allow air to enter the second component 20 from the bottom and then be discharged through the air outlet 230, thus forming air flow. Such flow can help heat dissipation, especially in an electronic device or a mechanical device which needs heat dissipation to maintain normal operation. From an aesthetic point of view, this design can also make the device look more beautiful. The relative positions and shapes of the air outlet 230 and the second air inlet 234 can be coordinated with the overall design of the device, thereby improving the overall visual effect.

In a specific embodiment, the second air inlets 234 can be arranged in two circles or one circle. When arranged in one circle, four square second air inlets 234 are provided. When the second air inlets are arranged in two circles, the second circle is provided outside the first circle. The second air inlets 234 are arranged at equal intervals.

The present disclosure further includes a hookah, which includes an airway structure of the electronic hookah 1000 and a container. The second component 20 of the main unit 1 is communicated with the container filled with filtrate.

Figure 2:
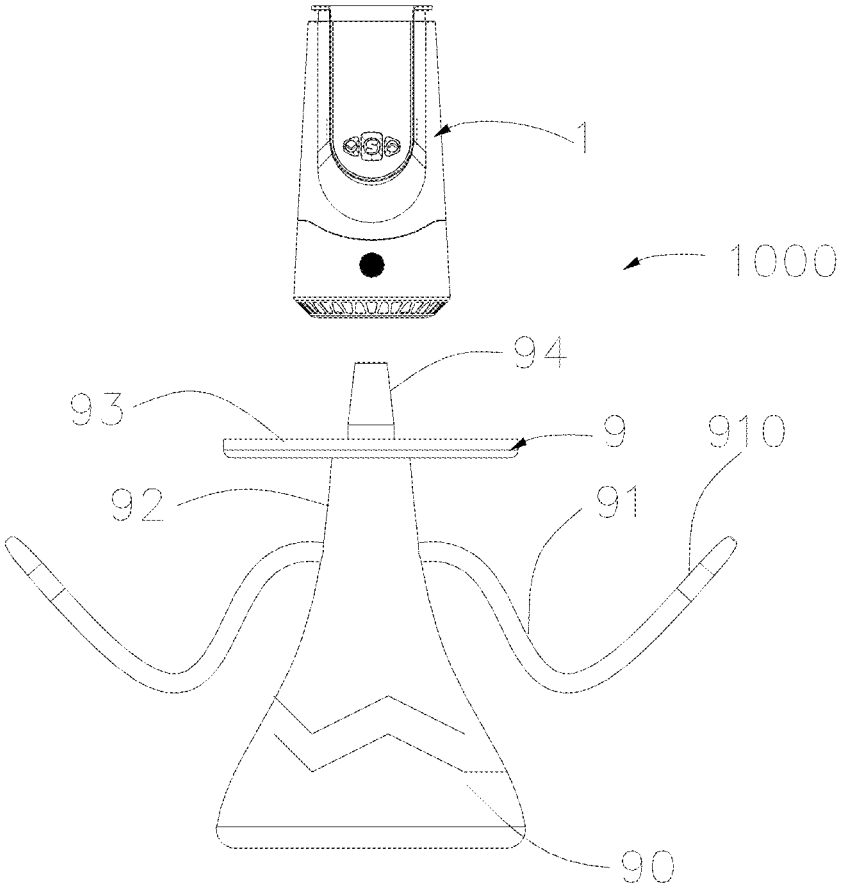
FIG. 2 is an exploded schematic diagram of an electronic hookah shown in FIG. 1.

As an example, referring to FIG. 1 and FIG. 2, FIG. 1 shows an electronic hookah 1000 according to an embodiment of the present disclosure. The electronic hookah 1000 includes a main unit 1 and a container 9. The main unit 1 is an electronic device assembled in the container 9. The main unit 1 contains the tobacco materials 2215, and heats the tobacco materials 2215 during operation, so as to form smoke and causes the smoke to flow into the container 9. The container 9 contains edible filtrate 90, such as water. The smoke flows into the container 9 and is filtered by the filtrate 90. The container 9 is provided with a pipe 91 with a mouthpiece 910. The user can suck the filtered smoke through the mouthpiece 910. In this embodiment, the discharge power of the electronic hookah 1000 is 100 W. In this embodiment, the container 9 includes a kettle body 92 configured to contain the filtrate 90, a support table 93, and an adapter 94 which is arranged on the support table 93 and is communicated with the kettle body 92. The container 9 is assembled with the main unit 1 through the adapter 94, so that the main unit 1 is carried on the support table 93.

Figure 3:
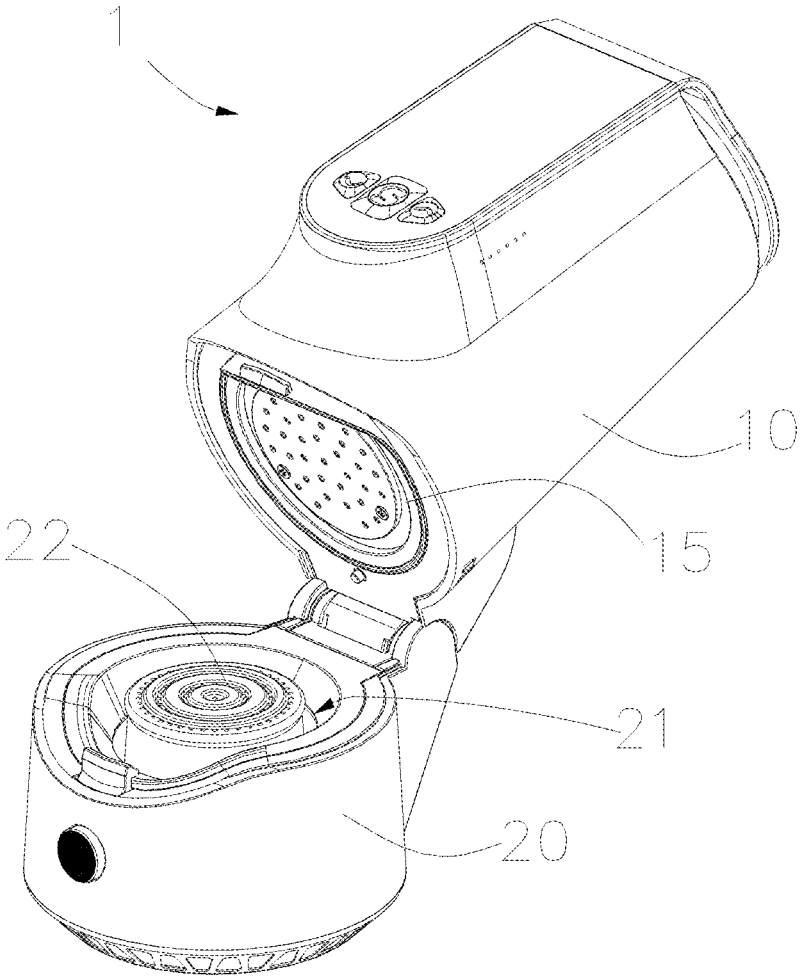
FIG. 3 is a three-dimensional diagram of a main unit of an electronic hookah according to an embodiment of the present disclosure in a first state, the main unit including a first component and a second component.
Figure 4:
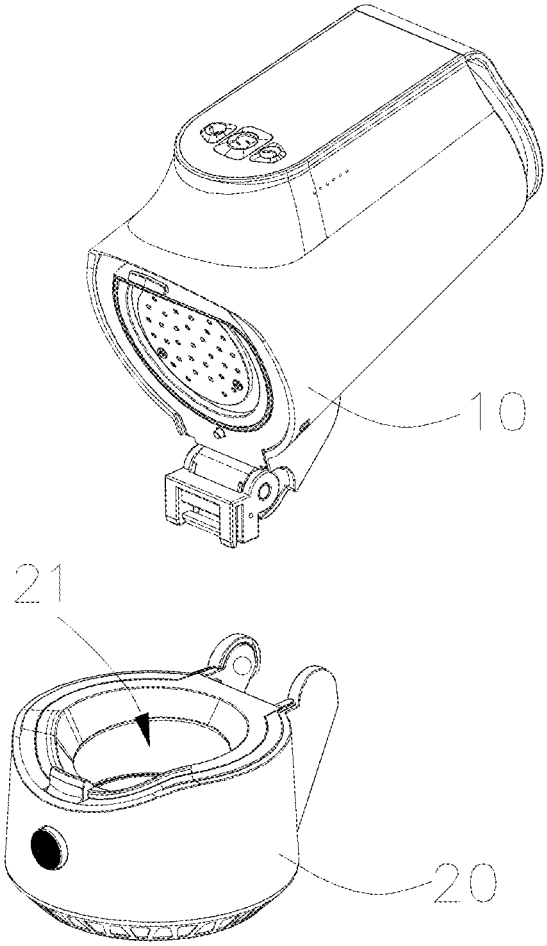
FIG. 4 is a three-dimensional schematic diagram of a main unit shown in FIG. 3 in a second state.

As an example, in conjunction with FIG. 3 and FIG. 4, FIG. 3 and FIG. 4 show schematic diagrams in different states. The main unit 1 includes a first component 10 and a second component 20 assembled with the first component 10. In this embodiment, the first component 10 and the second component 20 can rotate with respect to each other to open or close the main unit 1, and the first component 10 and the second component 20 are operatively combined or completely separated.

Figure 5:
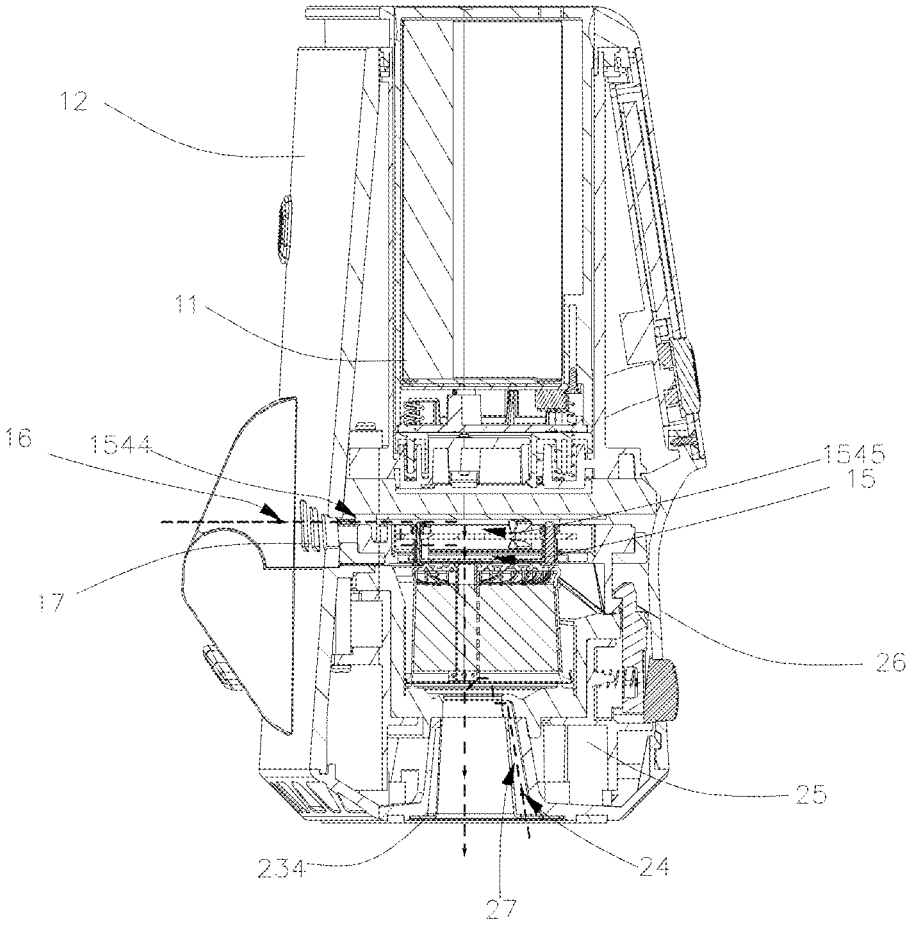
FIG. 5 is a cross-sectional schematic diagram of a main unit shown in FIG. 3 from a first angle.
Figure 6:
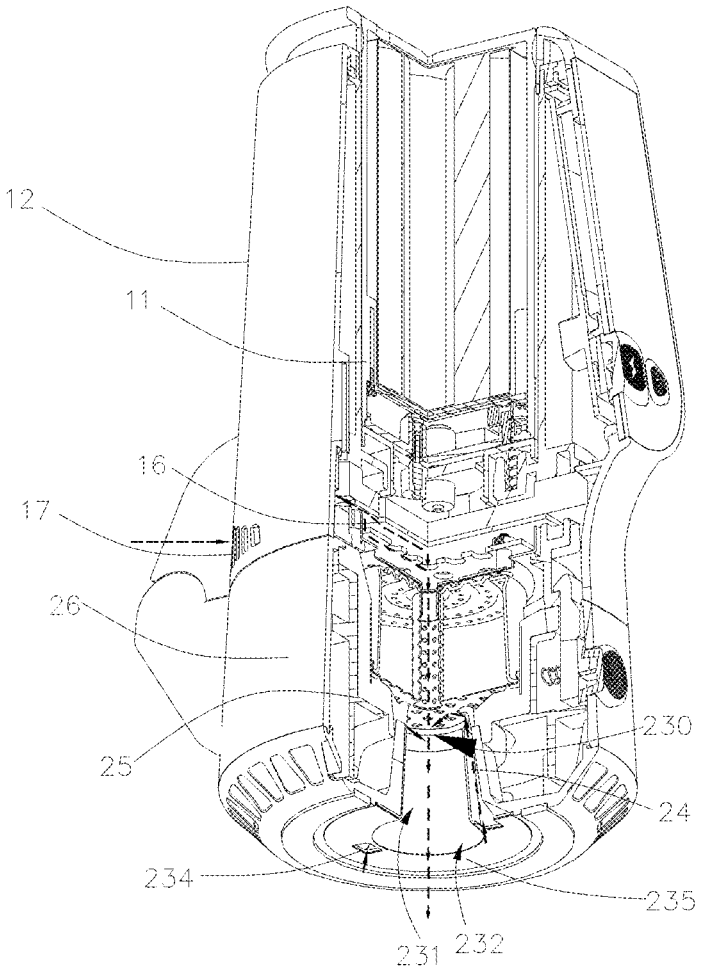
FIG. 6 is a cross-sectional schematic diagram of a main unit shown in FIG. 3 from a second angle.

As an example, in conjunction with FIG. 5 and FIG. 6, FIG. 5 and FIG. 6 show the cross-sectional diagrams of the main unit at different angles. The first component 10 includes a first bracket 11, a first housing 12 surrounding the first bracket 11, a heating component 15, a first airway 16, and a first air inlet 17 communicated with the first airway 16. The first air inlet 17 is arranged in the first housing 12, and the heating component 15 is arranged in the first bracket 11 and partially exposed to the first housing 12.

Figure 7:
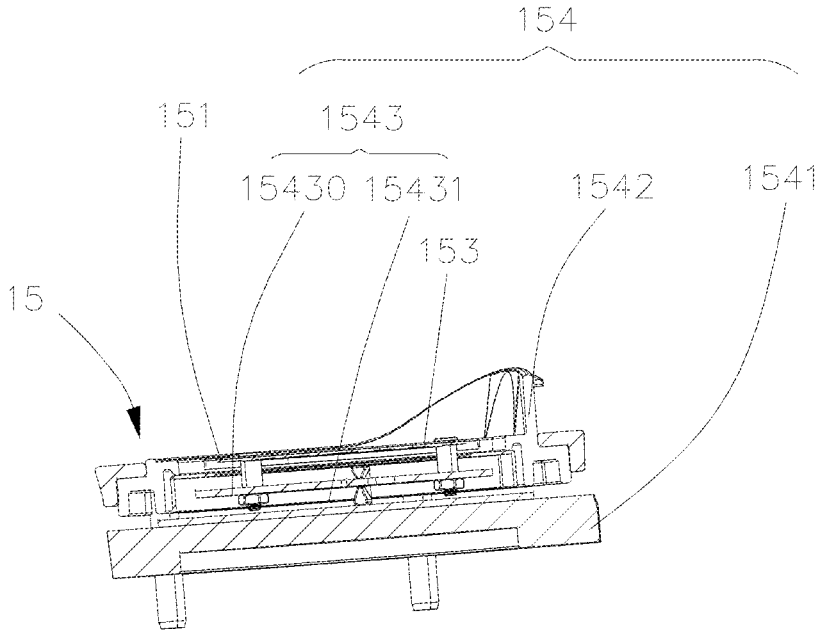
FIG. 7 is a cross-sectional schematic diagram of a heating component according to an embodiment of the present disclosure.

As an example, in conjunction with FIG. 7, FIG. 7 shows a cross-sectional diagram of the heating component. The heating component 15 includes a heating assembly 151, a protective cover 153, and a heat insulation assembly 154. One side of the heating assembly 151 is covered by the protective cover 153. The heat insulation assembly 154 covers the position of the heating assembly 151 except the position covered by the protective cover 153. The heating assembly 151 is configured to generate heat. The protective cover 153 is configured to protect the heating assembly 151. The heat insulation assembly 154 is configured to block the heat of the heating assembly 151 from being transferred to the outside.

Figure 9:
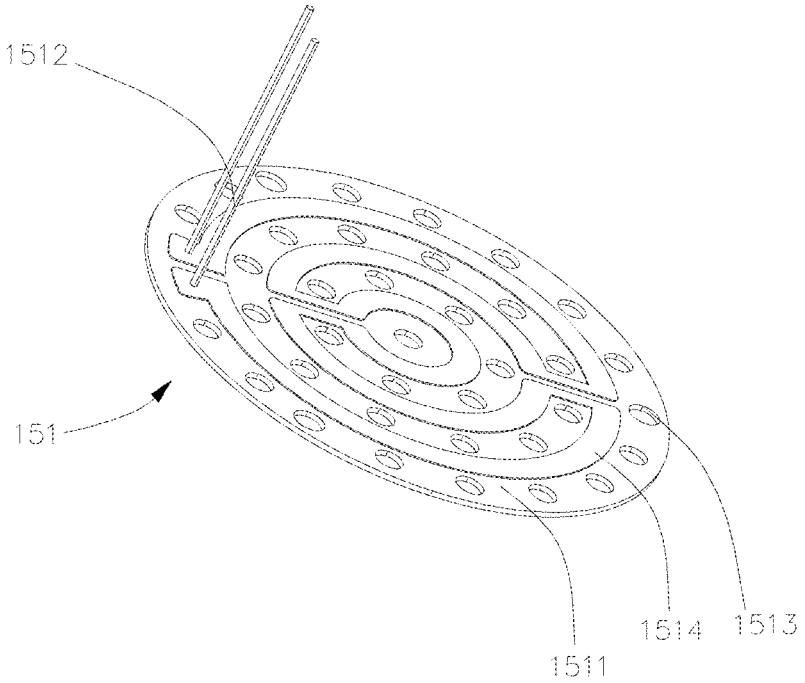
FIG. 9 is a three-dimensional schematic diagram of a heating assembly according to an embodiment of the present disclosure.

In a specific embodiment, referring to FIG. 9, the heating assembly 151 includes a substantially disc-shaped sheet-like heating element 1511 and a connecting line 1512 extending from the sheet-like heating element 1511 to the top of the main unit 1. The sheet-like heating element 1511 is provided with a second air vent 1513. The sheet-like heating element 1511 is located on the first airway 16. The second air vent 1513 is used for the flow of the first airway 16. The sheet-like heating element 1511 is provided with an electric heating material 1514. The electric heating material 1514 is made by thick film printing and low-temperature glaze firing. In this embodiment, the electric heating material 1514 is provided on the sheet-like heating element 1511 in a plane spiral shape. In this embodiment, the sheet-like heating element 1511 uses SUS430 super-thermal conductive material as the electric heating material 1514.

As an example, the heat insulation assembly 154 includes a heat insulation bracket 1542, a heat insulator 1541, and a heat insulation sheet assembly 1543. The heat insulation bracket 1542 and the heat insulator 1541 are arranged at intervals to form a first gap 1544. The first gap 1544 is annular. Air enters the heating component 15 through the first air inlet 17 and the first gap 1544. The heat insulation sheet assembly 1543 is located between the heat insulation bracket 1542 and the heat insulator 1541. The heat insulator 1541 is located on the side of the heating component 15 away from the second component 20. The heating assembly 151 is arranged between the heat insulation bracket 1542 and the heat insulator 1541 and is exposed to the heat insulation bracket 1542 through the connecting line 1512.

Figure 8:
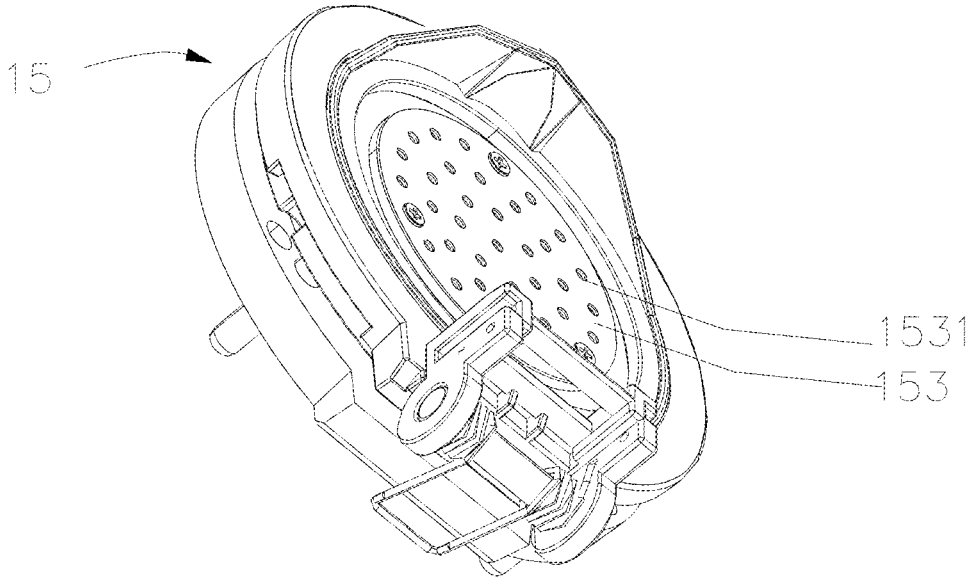
FIG. 8 is a three-dimensional schematic diagram of a heating component according to an embodiment of the present disclosure.

As an example, referring to FIG. 8, the protective cover 153 is arranged opposite to the sheet-like heating element 1511 and faces the second component 20. The protective cover 153 is further provided with a third air vent 1531. The protective cover 153 is located on the first airway 16. The third air vent 1531 is communicated with the first airway 16. In this embodiment, the protective cover 153 is fixed to the heat insulation assembly 154 by a fixing member (not shown in the figures). The protective cover 153 covers the surface of the sheet-like heating element 1511 facing the second component 20 to prevent the sheet-like heating element 1511 from being directly exposed to the outside and being damaged. In this embodiment, the protective cover 153 is made of stainless steel. The protective cover 153 has a disc shape adapted to that of the sheet-like heating element 1511.

Figure 10:
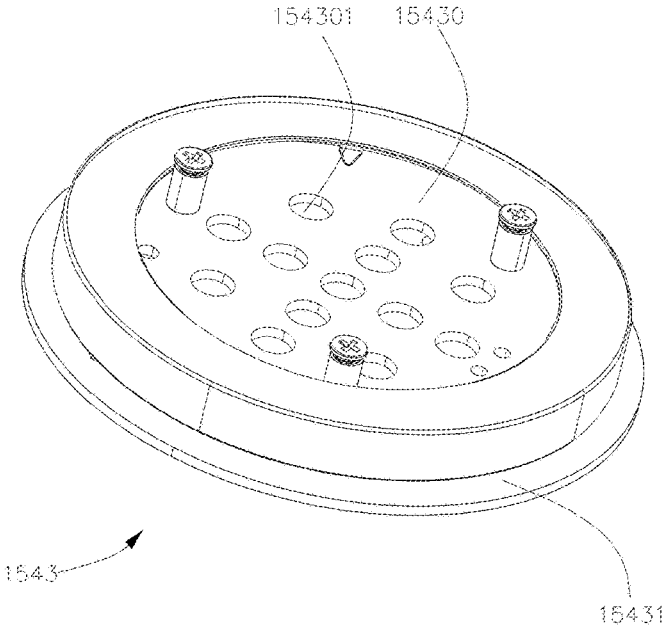
FIG. 10 is a three-dimensional schematic diagram of a heat insulation sheet assembly according to an embodiment of the present disclosure.

As an example, referring to FIG. 10, the heat insulation sheet assembly 1543 includes a first heat insulation sheet 15430 and a second heat insulation sheet 15431 arranged in parallel and at intervals. A second gap 1545 is formed between the first heat insulation sheet 15430 and the second heat insulation sheet 15431. The heat insulation sheet assembly 1543 is located on the first airway 16. The first heat insulation sheet 15430 is provided with a fourth air vent 154301 for the first airway 16 to flow to the heating assembly 151. In this embodiment, the cross sections of the first heat insulation sheet 15430 and the second heat insulation sheet 15431 are circular. The first heat insulation sheet 15430 is close to the heating assembly 151, and the second heat insulation sheet 15431 is close to the heat insulator 1541. The diameter of the second heat insulation sheet 15431 is greater than that of the first heat insulation sheet 15430.

In a specific embodiment, the first heat insulation sheet 15430 and the second heat insulation sheet 15431 are both mica sheets.

As an example, a plurality of first air inlets 17 are provided, and the plurality of first air inlets 17 are arranged along the position corresponding to the annular shape of the first gap 1544. The plurality of first air inlets 17 are longitudinally symmetrically arranged on both sides of the first housing 12, and the first air inlets 17 on each side are arranged side by side. In this embodiment, the number of the plurality of first air inlets 17 is ten, and the number of the first air inlets 17 on each side is five. The first air inlets 17 are in a strip shape, and the lengths of the first air inlets 17 decrease in sequence in the direction away from the first air inlets 17 on the other side.

As an example, the first airway 16 passes through the first air inlet 17, the heating component 15, the atomizing pot 22, and the air outlet 230 in sequence. Specifically, the external unheated air flows into the first component 10 from the first air inlet 17, enters the heating component 15 through the first gap 1544, flows out of the heating component 15 through the second gap 1545, the second air vent 1513, and the third air vent 1531 in sequence, and enters the atomizing pot 22 to be in contact with the tobacco materials 2215 in the atomizing pot 22. The tobacco materials 2215 are atomized to obtain smoke under the heat of the heating component 15. The smoke flows out of the air outlet 230 and enters the container 9.

As an example, the second component 20 is provided with a second bracket 25, a second housing 26 surrounding the second bracket 25, an atomizing pot 22, a heating chamber 21 configured to mount the atomizing pot 22, an adapter portion 23, a second airway 24, and a second air inlet 234 communicated with the second airway 24. The second air inlet 234 is provided in the second housing 26. The atomizing pot 22 is configured to load the tobacco materials 2215. The tobacco materials 2215 include but are not limited to tobacco pastes, tobaccos, etc. The second component 20 is assembled with the container 9 through the adapter portion 23. The adapter portion 23 is provided with an air outlet 230 passing through the adapter portion 23 in the vertical direction. The air outlet 230 is communicated with the heating chamber 21.

Figure 11:
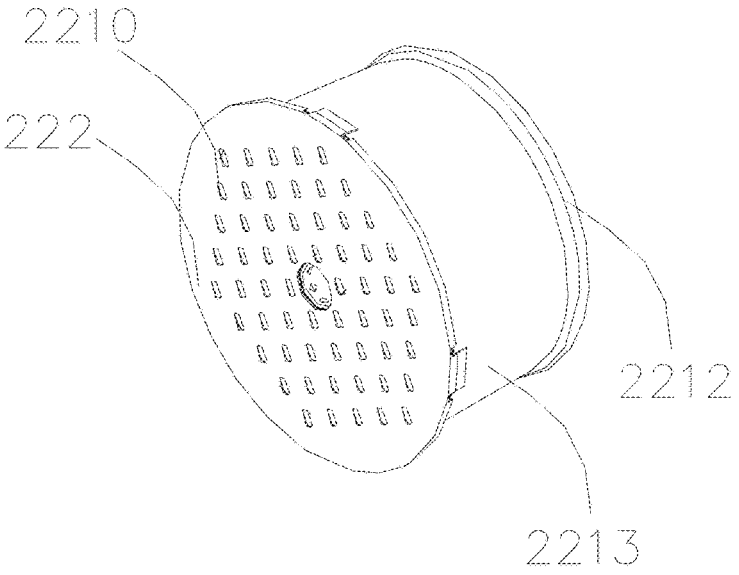
FIG. 11 is a three-dimensional schematic diagram of an atomizing pot according to an embodiment of the present disclosure.
Figure 12:
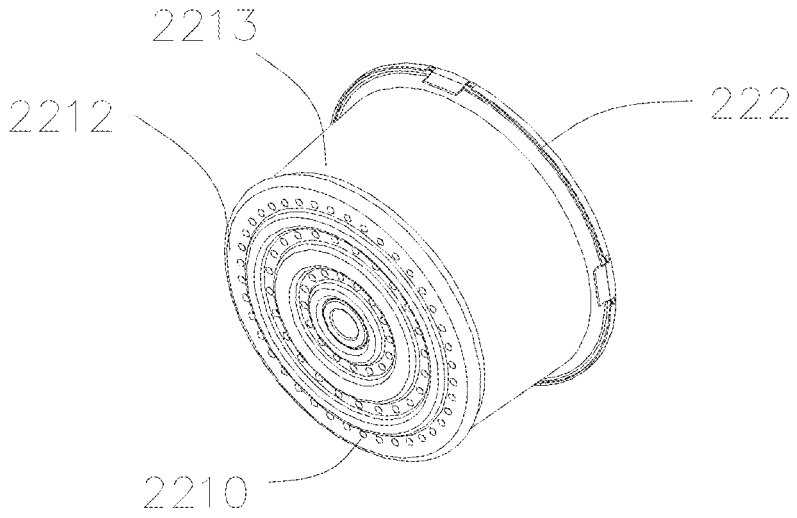
FIG. 12 is a three-dimensional schematic diagram of an atomizing pot shown in FIG. 11.

In a specific embodiment, referring to FIG. 11 and FIG. 12, FIG. 11 and FIG. 12 show three-dimensional schematic diagrams of the atomizing pot 22 from two different angles. The atomizing pot 22 includes a pot body 221, a pot cover 222, and tobacco materials 2215. The heating component 15 is arranged opposite to the outside of the atomizing pot 22, and is in direct contact with the atomizing pot 22 through the pot body 221.

Figure 13:
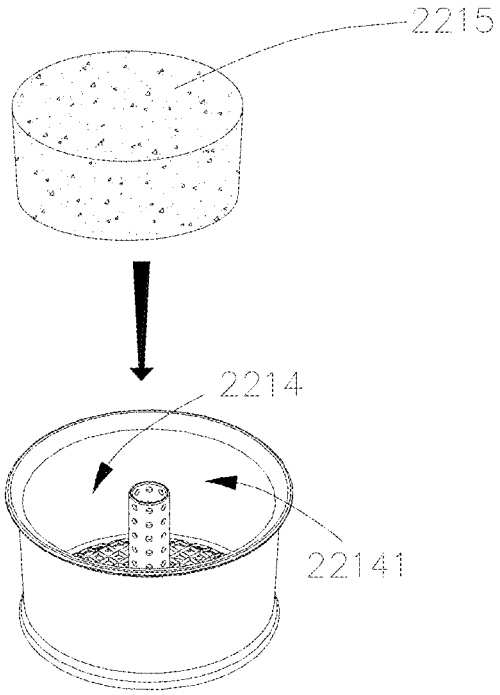
FIG. 13 is a three-dimensional exploded schematic diagram of a pot body and a tobacco material shown in FIG. 11.

In a specific embodiment, referring to FIG. 13, FIG. 13 is a three-dimensional exploded schematic diagram of a pot body and a tobacco material. The pot body 221 includes a top 2212, a side wall 2213 extending around the edge of the top 2212, and a cavity 2214 with an opening 22141 encircled by the top 2212 and the side wall 2213. The top 2212 is in direct contact with the atomizing pot 22, and is configured to be heated by the heating assembly 151 to generate heat. The top 2212 is opposite to the pot cover 222, and is provided with a first air vent 2210. The first air vent 2210 is configured to guide the air outside the atomizing pot 22 to the cavity 2214. In the present disclosure, the tobacco materials 2215 are contained in the cavity 2214 with the opening 22141 provided in the pot body 221. The pot cover 222 covers the cavity 2214, so that the tobacco materials 2215 are confined in the atomizing pot 22. The material of the pot body 221 can be easy to conduct and store heat, such as stainless steel.

In an embodiment of the present disclosure, the pot cover 222 is detachably mounted at one end of the side wall 2213 away from the top 2212. The pot cover 222 covers the opening 22141, so that when the top 2212 is heated, the heat of the side wall 2213 is partially conducted to the pot cover 222, and the heat received by the tobacco materials 2215 at different positions of the cavity 2214 is further evenly heated. The specific features of the pot cover 222 will be further described hereinafter.

In a specific embodiment, the pot cover 222 is further provided with a first air vent 2210. The first air vent 2210 is configured to guide the air outside the atomizing pot 22 to the cavity 2214 and guide the smoke inside the cavity 2214 to the outside of the atomizing pot 22. In the present disclosure, the shape and the number of the first air vents 2210 and the interval between the first air vents 2210 are only an example of the first air vents 2210, rather than limiting the first air vents 2210. That is, the shape and the number of the first air vents 2210 and the interval between the first air vents 2210 can be adjusted according to the requirements of the atomizing pot 22.

In a specific embodiment, as shown in FIG. 6, the adapter portion 23 includes an adapter portion body 231, an air outlet 230 close to the first component 10, a socket 232 away from the first component 10, and a second air inlet 234. The adapter portion 23 is surrounded by the second brackets 25, and there is a gap 27 between the adapter portion 23 and the second brackets 25. The gap 27 is communicated with the second air inlet 234. The second air inlet 234 is arranged along the position corresponding to the gap 27, and the second air inlet 234 is arranged at the bottom of the second component 20 away from the first component 10. The air outlet 230, the adapter portion body 231, and the socket 232 are communicated with each other. The air outlet 230 is opposite to the atomizing pot 22 for outputting the smoke generated by the atomizing pot 22.

Figure 14:
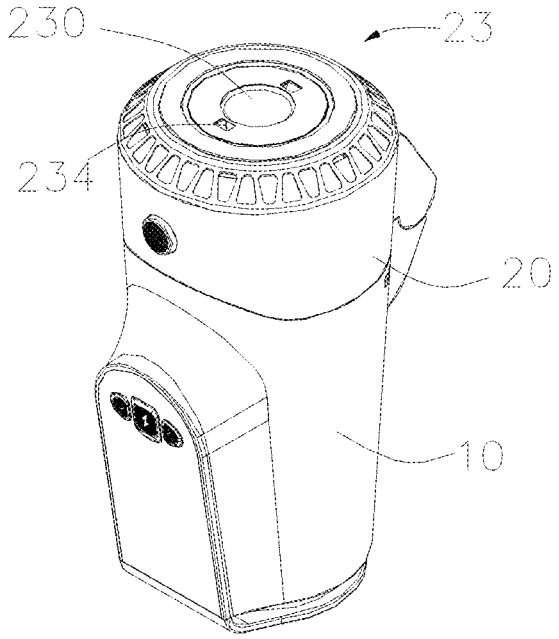
FIG. 14 is a bottom schematic diagram of a main unit shown in FIG. 3.

In a specific embodiment, referring to FIG. 14, in the above embodiment, the socket 232 extends outward from the edge 235 perpendicularly to the axis of the adapter portion 23. The edge 235 is provided with a plurality of notches at certain intervals. The plurality of notches form a plurality of second air inlets 234. The orientation of the second air inlets 234 is the same as that of the socket 232. In this embodiment, the number of the second air inlets 234 is two. The two second air inlets 234 are arranged opposite to each other on both sides of the edge 235. The air outlet 230 is arranged at the center of the bottom of the main unit 1, and the second air inlets 234 are arranged around the air outlet 230 at equal intervals with the air outlet 230 as the center.

In a specific embodiment, the second airway 24 passes through the second air inlet 234, the gap 27, the atomizing pot 22, and the air outlet 230 in sequence. The external unheated air flows into the second component 20 from the second air inlet 234, and enters the atomizing pot 22 through the gap 27 to be in contact with the tobacco materials 2215 in the atomizing pot 22. The tobacco materials 2215 are atomized to obtain smoke under the heat of the heating component 15. The smoke flows out of the air outlet 230 and enters the container 9. The direction in which the air flows from the first air inlet 17 is perpendicular to the direction in which the air flows from the second air inlet 234.

In a specific embodiment, the electronic hookah 1000 and the main unit 1 are included. The external unheated air flows into the main unit from the first air inlet 17 and the second air inlet 234, and enters the atomizing pot 22 from the first air inlet 16 and the second air inlet 24, respectively, to be in contact with the tobacco materials 2215 in the atomizing pot 22, so that the tobacco materials 2215 are in full contact with the air, thereby improving the heating and atomizing efficiency of the tobacco materials 2215.

Finally, it should be noted that, relational terms such as first and second are only used to distinguish one entity or operation from another herein and do not necessarily require or imply that there is any such actual relationship or order between these entities or operations. Moreover, the terms "include", "contain" or any other variation thereof are intended to cover non-exclusive inclusion, so that a process, a method, an article or a terminal device including a series of elements includes not only those elements, but also other elements not explicitly listed, or elements inherent to such process, method, article or terminal device. Without more restrictions, the element defined by the phrase "including a/an . . . " does not exclude that there are other identical elements in the process, method, article or terminal device including the element.

A hookah main unit with an enhanced atomizing airway, a tobacco material pot and an electronic hookah according to the present disclosure are described in detail above. The principle and implementations of the present disclosure are illustrated herein by using specific examples, and the description of the above embodiments is only used to help understand the method and the core idea of the present disclosure. At the same time, according to the idea of the present disclosure, there will be some changes in the detailed description and the application scope for those skilled in the art. To sum up, the contents of this specification should not be understood as limiting the present disclosure.

What is claimed is:

1. A hookah main unit with an enhanced atomizing airway, comprising a main unit, wherein:

the main unit is provided with a first air inlet, a second air inlet, an air outlet, a cavity configured to load tobacco materials, and a heating component configured to heat the tobacco materials, and at least one second air inlet is provided;

the first air inlet is communicated with the air outlet to form a first airway; and when air is pumped through the air outlet, the external unheated air enters through the first air inlet, and is heated by the heating component, mixed with gas at a second temperature in the cavity and discharged from the air outlet, wherein a temperature of the external unheated air after being heated is lower than the second temperature;

the second air inlet is communicated with the cavity and the air outlet to form a second airway; and when air is pumped through the air outlet, external unheated air enters through the second air inlet to be mixed with a heated gas around the tobacco materials in the cavity, and is discharged from the air outlet.

2. The hookah main unit with an enhanced atomizing airway according to claim 1, wherein a heating surface of the heating component is arranged opposite to the cavity.

3. An electronic hookah, comprising the hookah main unit with an enhanced atomizing airway according to claim 2 and a container, wherein:

a second component is communicated with the container filled with filtrate.

4. The hookah main unit with an enhanced atomizing airway according to claim 1, wherein an opening of the second air inlet has a height not greater than the highest level of the tobacco materials.

5. An electronic hookah, comprising the hookah main unit with an enhanced atomizing airway according to claim 4 and a container, wherein:

a second component is communicated with the container filled with filtrate.

6. The hookah main unit with an enhanced atomizing airway according to claim 1, wherein the main unit comprises a first component and a second component connected with the first component;

the first component is provided with the heating component; and the second component is provided with the second air inlet, the air outlet, and the cavity;

or, the first component is provided with the heating component and the cavity, and the second component is provided with the second air inlet and the air outlet.

7. An electronic hookah, comprising the hookah main unit with an enhanced atomizing airway according to claim 6 and a container, wherein:

a second component is communicated with the container filled with filtrate.

8. The hookah main unit with an enhanced atomizing airway according to claim 1, wherein the main unit comprises a first component and a second component connected with the first component;

the first component is provided with the heating component, the cavity, and the second air inlet, and the second component is provided with the air outlet;

or, the first component is provided with the heating component and the second air inlet, and the second component is provided with the air outlet and the cavity.

9. An electronic hookah, comprising the hookah main unit with an enhanced atomizing airway according to claim 8 and a container, wherein:

a second component is communicated with the container filled with filtrate.

10. The hookah main unit with an enhanced atomizing airway according to claim 6, wherein the second air inlet is arranged at the bottom of the second component.

11. An electronic hookah, comprising the hookah main unit with an enhanced atomizing airway according to claim 10 and a container, wherein:

a second component is communicated with the container filled with filtrate.

12. The hookah main unit with an enhanced atomizing airway according to claim 6, wherein the air outlet is arranged at the center of the bottom of the second component, and the second air inlet is arranged around the air outlet.

13. An electronic hookah, comprising the hookah main unit with an enhanced atomizing airway according to claim 12 and a container, wherein:

a second component is communicated with the container filled with filtrate.

14. The hookah main unit with an enhanced atomizing airway according to claim 1, wherein the second air inlets are arranged at equal intervals.

15. An electronic hookah, comprising the hookah main unit with an enhanced atomizing airway according to claim 14 and a container, wherein:

a second component is communicated with the container filled with filtrate.

16. An electronic hookah, comprising a hookah main unit with an enhanced atomizing airway and a container, wherein:

the main unit is provided with a first air inlet, a second air inlet, an air outlet, a cavity configured to load tobacco materials, and a heating component configured to heat the tobacco materials, and at least one second air inlet is provided;

the first air inlet is communicated with the air outlet to form a first airway; and when air is pumped through the air outlet, the external unheated air enters through the first air inlet, and is heated by the heating component, mixed with gas at a second temperature in the cavity and discharged from the air outlet, wherein a temperature of the external unheated air after being heated is lower than the second temperature;

the second air inlet is communicated with the cavity and the air outlet to form a second airway; and when air is pumped through the air outlet, external unheated air enters through the second air inlet to be mixed with a heated gas around the tobacco materials in the cavity, and is discharged from the air outlet;

a second component is communicated with the container filled with filtrate.

* * * * *